US010806314B2

(12) United States Patent
Suchman et al.

(10) Patent No.: US 10,806,314 B2
(45) Date of Patent: Oct. 20, 2020

(54) WET FLOORCARE ROBOT CLEANER TANK LATCH

(71) Applicant: iRobot Corporation, Bedford, MA (US)

(72) Inventors: Jason Jeffrey Suchman, Arlington, MA (US); William Farmer, Bedford, MA (US); Johnson Hsu, Sudbury, MA (US)

(73) Assignee: iRobot Corporation, Bedford, MA (US)

( * ) Notice: Subject to any disclaimer, the term of this patent is extended or adjusted under 35 U.S.C. 154(b) by 264 days.

(21) Appl. No.: 15/863,086

(22) Filed: Jan. 5, 2018

(65) Prior Publication Data

US 2019/0208970 A1 Jul. 11, 2019

(51) Int. Cl.

| | |
|---|---|
| ***A47L 7/00*** | (2006.01) |
| ***A47L 11/40*** | (2006.01) |
| ***A47L 11/28*** | (2006.01) |

(52) U.S. Cl.

CPC ..... *A47L 7/0028* (2013.01); *A47L 7/0038* (2013.01); *A47L 7/0042* (2013.01); *A47L 11/28* (2013.01); *A47L 11/4016* (2013.01); *A47L 11/4075* (2013.01); *A47L 11/4083* (2013.01); *A47L 11/4088* (2013.01); *A47L 2201/00* (2013.01);

(Continued)

(58) Field of Classification Search

CPC ..... A47L 7/0004; A47L 7/0023–38; A47L 11/408; A47L 11/4083; A47L 2201/026; Y10T 292/1043; Y10T 292/38; Y10T 292/11

USPC ..... 15/319

See application file for complete search history.

(56) References Cited

U.S. PATENT DOCUMENTS

| | | | | |
|---|---|---|---|---|
| 2,944,864 A * | 7/1960 | Krivulka | ..... | E05B 65/46 312/332.1 |
| 5,548,866 A * | 8/1996 | Reed | ..... | A47L 11/34 15/320 |
| 8,452,450 B2 | 5/2013 | Dooley et al. | | |

(Continued)

FOREIGN PATENT DOCUMENTS

| | | |
|---|---|---|
| CN | 103070638 | 5/2013 |
| CN | 206285065 | 6/2017 |
| CN | 107307798 | 11/2017 |

OTHER PUBLICATIONS

Partial European Search Report in European Appln. No. EP 18207141, dated Jun. 6, 2019. 14 pages.

(Continued)

*Primary Examiner* — Bryan R Muller
*Assistant Examiner* — Thomas Raymond Rodgers
(74) *Attorney, Agent, or Firm* — Fish & Richardson P.C.

(57) ABSTRACT

In one aspect, an autonomous cleaning robot includes a drive configured to propel the robot along the floor surface and a tank assembly. The tank assembly includes a reservoir, left and right receptacles, and a handle extending across a cover of the tank assembly, the handle being moveable between a first position and a second position, wherein when the handle is in the second position, the tank assembly is locked in position. The tank assembly also includes left and right latch assemblies receivable by the left and right receptacles, respectively. Each latch assembly includes a moveable assembly configured to lock the tank assembly in position when the handle is in the second position.

16 Claims, 13 Drawing Sheets

(52) U.S. Cl.
CPC ..... *A47L 2201/04* (2013.01); *A47L 2201/06* (2013.01)

(56) References Cited

U.S. PATENT DOCUMENTS

| | | | | |
|---|---|---|---|---|
| 9,427,127 | B2 | 8/2016 | Dooley et al. | |
| 9,615,712 | B2 | 4/2017 | Dooley et al. | |
| 2017/0332853 | A1* | 11/2017 | Nam | A47L 5/30 |

OTHER PUBLICATIONS

Bissell, "Revolution Pet Pro, Quick Start/User Guide 1964, 1986, 2007 Series," www.bissell.com, [undated], 22 pages.

* cited by examiner

WET FLOORCARE ROBOT CLEANER TANK LATCH

TECHNICAL FIELD

This specification relates to latches for tank assemblies, in particular, for cleaning robots.

BACKGROUND

An autonomous cleaning robot can navigate across a floor surface and avoid obstacles while cleaning the floor surface. The cleaning robot can include a tank to hold fluid to be applied to the floor surface. As the cleaning robot moves across the floor surface, the robot can apply fluid from the tank assembly to the floor surface without leaking fluid from the tank assembly.

SUMMARY

In one aspect, an autonomous cleaning robot includes a drive configured to propel the robot along the floor surface and a tank assembly. The tank assembly includes a reservoir, left and right receptacles, and a handle extending across a cover of the tank assembly, the handle being moveable between a first position and a second position, wherein when the handle is in the second position, the tank assembly is locked in position. The tank assembly also includes left and right latch assemblies receivable by the left and right receptacles, respectively. Each latch assembly includes a moveable assembly configured to lock the tank assembly in position when the handle is in the second position. The moveable assembly includes a yoke pivotally connected to the handle. The moveable assembly also includes a hook pivotally connected to the yoke, the hook configured to move from a first position to a second position and engage with a catch of the receiving surface of the robot and lock the tank assembly in position when the hook is in the second position. The moveable assembly also includes a first flexible element connected to the yoke and the hook and a second flexible element connected to the hook, wherein flexibility of the first flexible element and the second flexible element allows the tank to be received and locked into position when the hook is in the second position.

In some implementations, the first flexible element and the second flexible element are approximately U-shaped.

In some implementations, each of the first flexible element and the second flexible element have two members separated from one another to allow the corresponding hook to move between the members.

In some implementations, each of the latch assemblies further comprise a roller configured to produce resistance against the handle when moving the handle from the first position to the second position.

In some implementations, the moveable assembly is configured such that the first flexible element produces resistance against the handle when moving the handle from the first position to the second position.

In some implementations, each of the left and right receptacles comprises an opening to receive the corresponding catch of the receiving surface of the robot.

In some implementations, the moveable assembly is configured such that the hook travels more during a first portion of the handle's movement than during a second portion of the handle's movement from the first position to the second position.

In some implementations, robot further includes a seal configured to seal the tank assembly to a receiving surface of the robot. In some cases, a force applied to the seal is between approximately 5 and 20 foot-pounds (e.g., approximately 5-10 foot-pounds, 10-15 foot-pounds, 15-20 foot-pounds) when the tank assembly is locked into position.

In another aspect, a tank assembly for an autonomous cleaning robot is featured. The tank assembly includes a reservoir, left and right receptacles, and a handle extending across a cover of the tank assembly, the handle being moveable between a first position and a second position, wherein when the handle is in the second position, the tank assembly is locked in position. The tank assembly also includes left and right latch assemblies receivable by the left and right receptacles, respectively. Each latch assembly includes a moveable assembly configured to lock the tank assembly in position when the handle is in the second position. The moveable assembly includes a yoke pivotally connected to the handle. The moveable assembly also includes a hook pivotally connected to the yoke, the hook configured to move from a first position to a second position and engage with a catch of the receiving surface of the robot and lock the tank assembly in position when the hook is in the second position. The moveable assembly also includes a first flexible element connected to the yoke and the hook and a second flexible element connected to the hook, wherein flexibility of the first flexible element and the second flexible element allows the tank to be received and locked into position when the hook is in the second position.

In some implementations, the first flexible element and the second flexible element are approximately U-shaped.

In some implementations, each of the first flexible element and the second flexible element have two members separated from one another to allow the corresponding hook to move between the members.

In some implementations, wherein each of the latch assemblies further comprise a roller configured to produce resistance against moving the handle from the first position to the second position.

In some implementations, the moveable assembly is configured such that the first flexible element and the handle produce resistance against the handle when moving the handle from the first position to the second position.

In some implementations, each of the left and right receptacles comprises an opening to receive the corresponding catch of the receiving surface of the robot.

In some implementations, wherein the moveable assembly is configured such that the hook travels more during a first portion of the handle's movement than during a second portion of the handle's movement from the first position to the second position.

In another aspect, tank assembly of an autonomous cleaning robot is featured. The tank assembly includes a snorkel assembly. The snorkel assembly includes a plunger configured to move between a first position and a second position, wherein a head of the plunger is more offset from a bottom surface of the tank assembly in the first position than in the second position, and a snorkel configured to interface with the plunger such that the snorkel separates from the bottom surface of the tank assembly when the plunger is in the second position. When the plunger is in the first position, the snorkel forms a seal with a protrusion of the bottom surface of the tank assembly and when the plunger is in the second position, a fluid pathway is provided between the snorkel and the protrusion. The seal is located above the bottom surface of the tank assembly and allows draining the tank assembly through the snorkel assembly to a level approximately equal to a level of the bottom surface.

In some implementations, the seal is positioned between approximately 16 and 24 mm above the level of the bottom surface of the tank.

In some implementations, the tank assembly further includes a spring configured to bias the plunger into the first position.

In some implementations, a portion of the bottom surface of the tank assembly is recessed below the level of the bottom surface of the tank. In some cases, the recessed portion of the bottom surface of the tank is ribbed. In some cases, when the plunger is in the first position, a rim of the snorkel contacts the recessed portion of the bottom surface of the tank.

Advantages of the foregoing may include, but are not limited to, those described below and herein elsewhere.

The latch for the tank assembly provides a mechanism for applying force to a seal between the tank assembly and a receiving surface of the cleaning robot. The force on the seal is strong enough to prevent leaking from the tank and/or the tank from becoming unseated as the cleaning robot moves across a floor surface during a cleaning mission where the cleaning robot may contact obstacles, make quick direction changes, and/or become tilted. This sealing protects the electrical components within the cleaning robot from being damaged by fluid and also prevents fluid from spilling.

The latch for the tank assembly is flexible and allows the tank assembly to provide tactile feedback to a user locking the tank assembly to the cleaning robot. The flexibility of the tank assembly also allows the latch to lock into place without breaking even when a user attempts to insert the tank assembly into the cleaning robot in an improper manner, making the tank assembly durable in spite of possible user error. For example, in the implementations discussed below, a hook of the latch is able to slide around a catch of the cleaning robot and then lock into a correct position when a user attempts to insert the tank assembly into the cleaning robot in an improper manner.

The tank assembly includes a snorkel assembly to provide a seal to the reservoir of the tank assembly and allow for fluid to be removed from the reservoir during a cleaning mission. The sealing surface of the snorkel assembly is located above a bottom surface of the reservoir, but the snorkel assembly has a geometry that allows fluid to be drained down to the bottom surface of the reservoir. This draining allows for less frequent fills of the tank and therefore for the cleaning robot to last longer on a cleaning mission without the need for fluid to be added.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
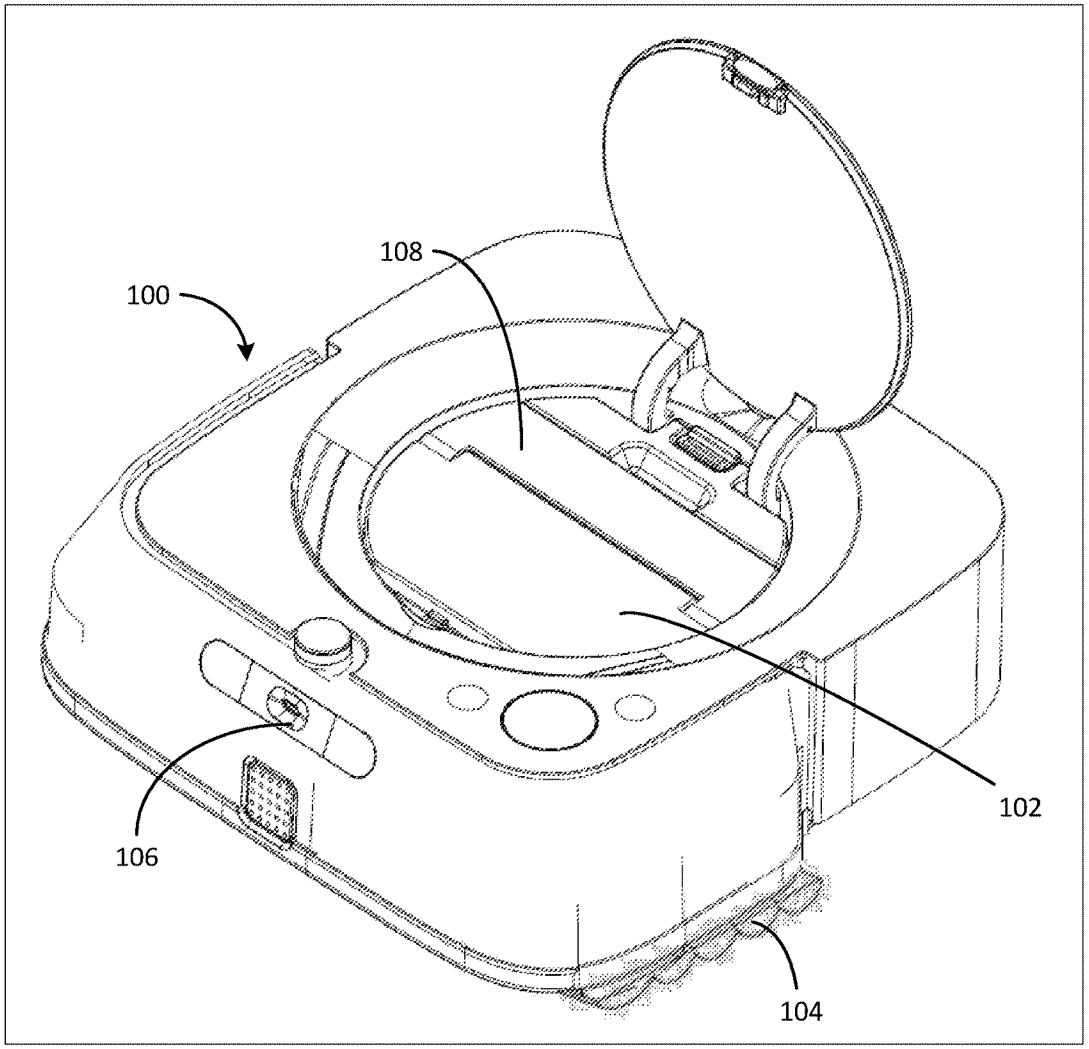
FIG. 1A is a perspective view of an autonomous cleaning robot including a tank assembly.
Figure 1B:
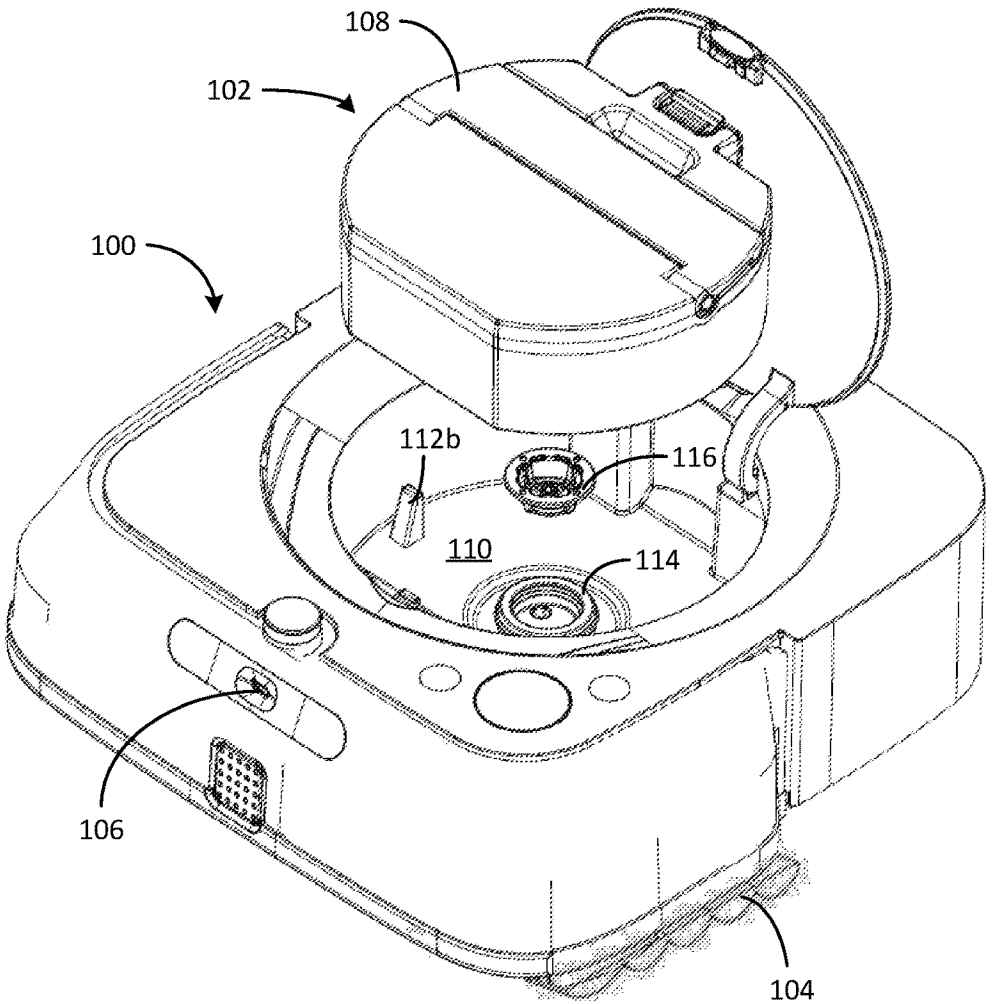
FIG. 1B is a perspective view of the autonomous cleaning robot of FIG. 1A with the tank assembly removed from the robot.

Referring to FIGS. 1A and 1B, a cleaning robot 100 includes a tank assembly 102 and a cleaning pad 104 positioned to engage debris on a floor surface. Fluid held within the tank assembly 102 is sprayed through nozzle 106 onto the floor surface to be cleaned. The robot 100 also includes a drive system configured to propel the robot 100 along the floor surface. The tank assembly 102 includes a handle 108 which is moveable and allows a user to lock and unlock the tank assembly 102 from the robot 100. Because the cleaning robot 100 autonomously traverses the floor surface as it cleans, making turns and bumping into objects as it moves, the tank assembly 102 should be sealed tightly to the robot 100 so that the tank assembly 102 does not move separately from the robot 100 as the robot 100 moves across the floor surface. This seal ensures that fluid held by the tank assembly 102 does not spill as the robot 100 moves across the floor surface and/or contacts objects.

As shown in FIG. 1B, the tank assembly 102 is removable from the robot 100. The tank assembly 102 includes a handle 108 for easily removing of the tank assembly 102 from the robot 100 and carrying the tank assembly 102 when it is separate from the robot 100. The tank assembly 102 interfaces with a receiving surface 110 of the robot 100 by locking to two catches 112*a* (not shown in FIG. 1B) and 112*b*, located on opposite sides of the receiving surface 110. A seal 114 and a filter 116 are positioned between the tank assembly 102 and the receiving surface 110 of the robot 100. When the tank assembly 102 is seated in and locked to the robot 100, a force (larger than a gravitational force alone) is applied to the seal 114, allowing the tank assembly 102 to remain sealed to the robot 100 even when the robot 100 contacts objects, makes quick turns, or becomes tilted during a cleaning mission. In some implementations, the seal may have multiple tiers.

Figure 2:
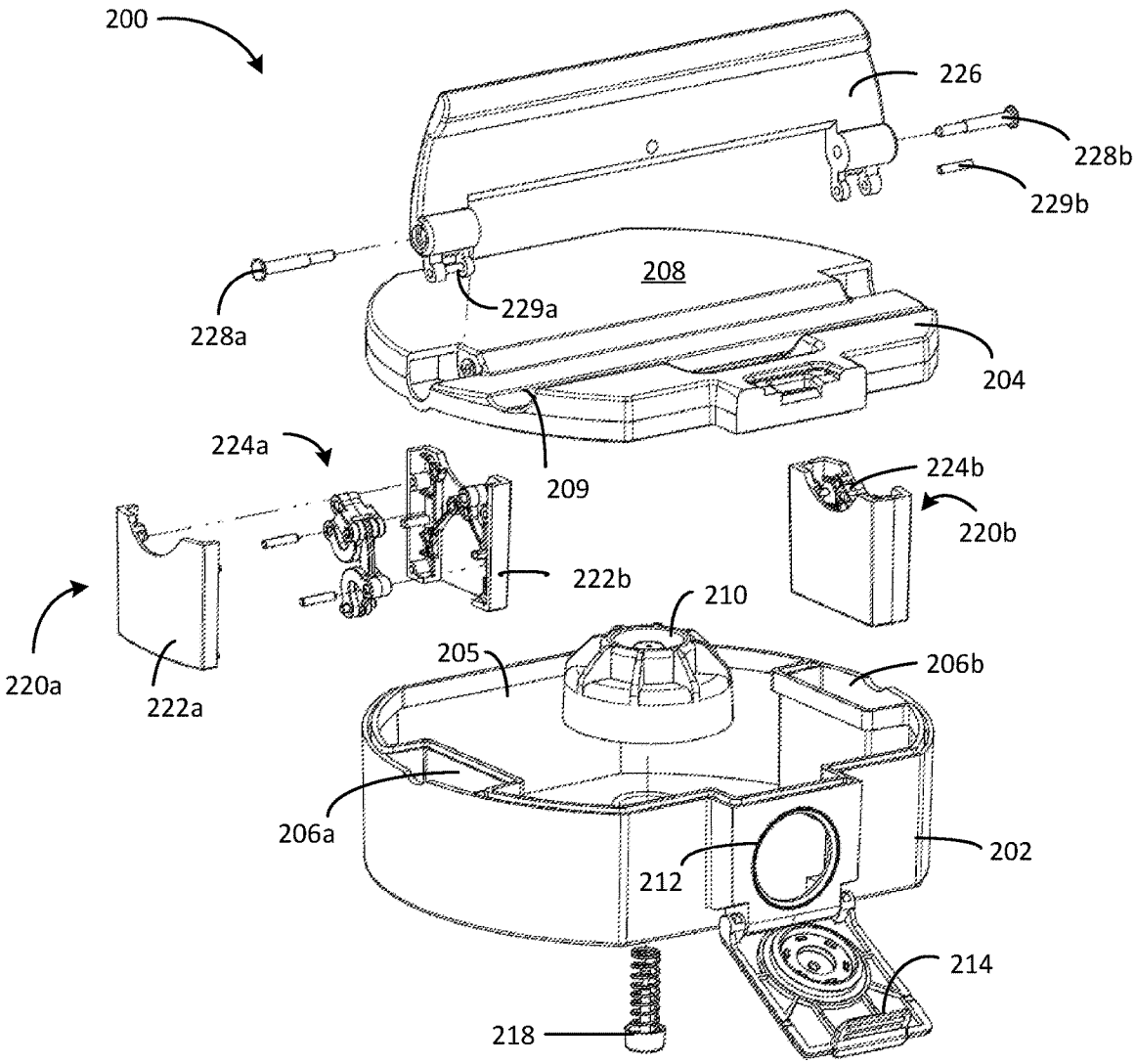
FIG. 2 is an exploded view of the tank assembly of the autonomous cleaning robot of FIG. 1A.

Referring to FIG. 2, an exploded view of the tank assembly 200 is shown to reveal its components. The tank assembly 200 includes a tank base 202 and a tank cover 204. The tank base 202 and the tank cover 204, in some implementations, may be made of, for example, a plastic material, a composite material, etc. The tank base 202 and the tank cover 204 may be welded together upon assembling the tank assembly 200. The tank base 202 includes a reservoir 205 configured to hold fluid (e.g., a cleaning fluid, water, etc.) to be applied to the floor surface by the robot 100 during a cleaning mission. The tank base 202 also includes a left receptacle 206*a* and a right receptacle 206*b*. The receptacles 206*a-b* are separated from the reservoir by dividing walls and include openings at the bottom to allow interfacing with the receiving surface 110 of the robot 100 (as shown in FIG. 1B). The left receptacle 206*a* is configured to receive a left latch assembly 220*a* and the right receptacle 206*b* is configured to receive a right latch assembly 220*b*. The left latch assembly 220*a* includes a moveable assembly 224*a* and two supporting structures 222*a-b*. The left latch assembly 220*a* is shown with additional detail in FIG. 3. The left and right latch assemblies 220*a-b* interface with a handle 226 of the tank assembly 200 such that as the handle 226 moves, the moveable assemblies 224*a-b* move within the latch assemblies 220*a-b*.

The handle 226 is connected to the tank cover 204 by pins 228*a-b* and to the moveable assemblies 224*a-b* by pins 229*a-b*. The pins 228*a-b* and 229*a-b* allow the handle 226 to rotate relative to the tank cover 204 and moveable assemblies 224*a-b*. The handle 226 is moveable from a first position, wherein the handle 226 is approximately perpendicular to a top surface 208 of the tank cover 204, to a second position, wherein the handle 226 is approximately parallel to the top surface 208 of the tank cover 204. The tank cover 204 includes an indentation 209 to allow the handle 226 to form an approximately flush surface with the top surface 208 of the tank cover 204 when the handle 226 is in the second position.

The tank assembly 200 also includes a plunger 218 and a snorkel 210 which are portions of a snorkel assembly configured to seal the reservoir 205. The snorkel assembly, including the plunger 218 and the snorkel 210, is discussed further below in the description of FIGS. 6A and 6B.

Latching the Tank Assembly to the Robot

Figure 3:
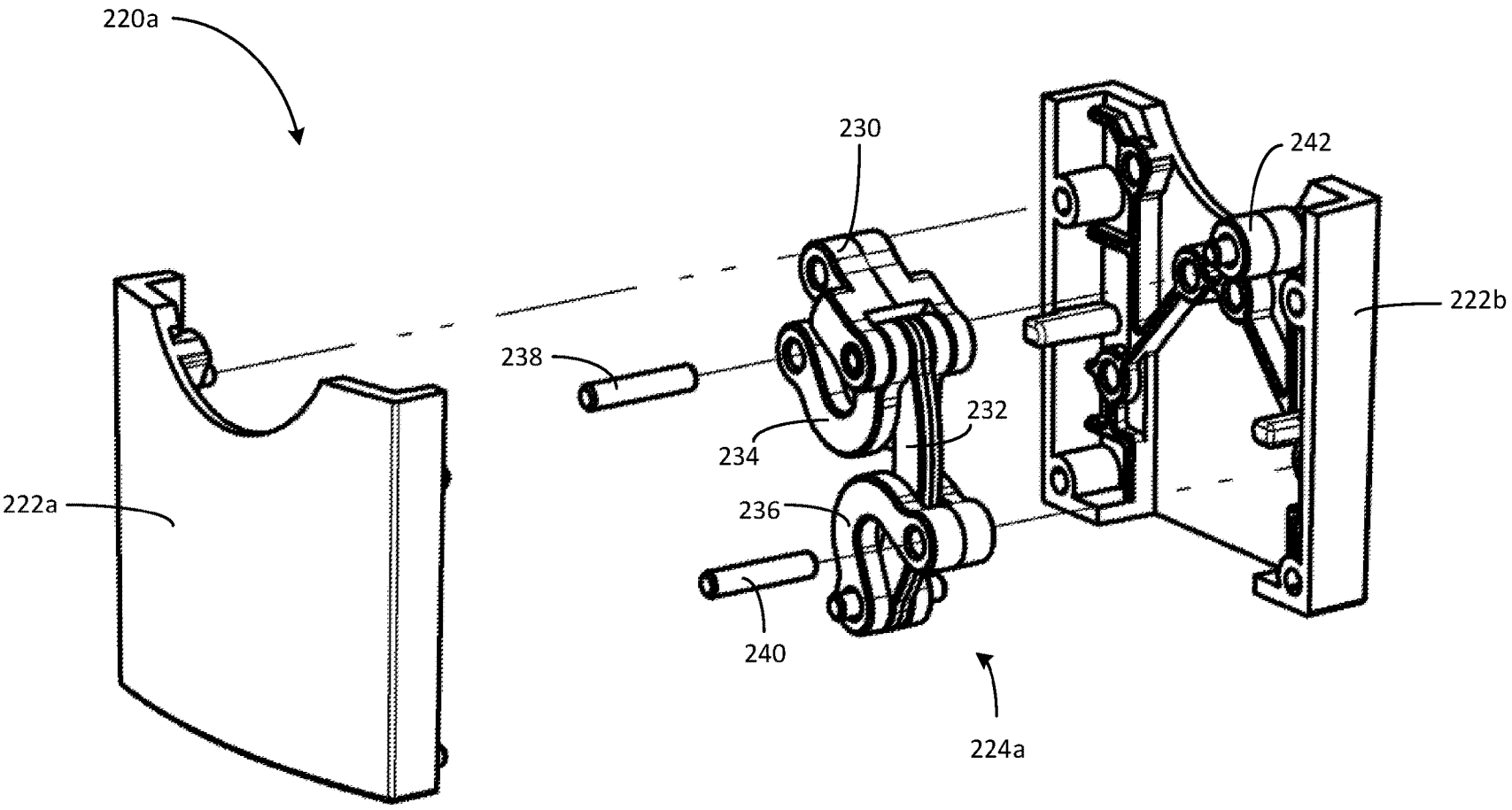
FIG. 3 is an exploded view of a latch assembly of the tank assembly of FIG. 2.

Referring to FIG. 3, the left latch assembly 220*a* is shown in an exploded view. The left latch assembly 220*a* includes the support structures 222*a-b* and the moveable assembly 224*a*. The moveable assembly 224*a* includes a yoke 230, a hook 232, a first flexible element 234, and a second flexible element 236. The yoke 230 is connected to the hook 232 and the first flexible element 234 at one end and is connected to the handle 226 by pin 229*a* (as shown in FIG. 2). The hook 232 is connected to the yoke 230 and the first flexible element 234 at a first end and is connected to the second flexible element 236 near a second end. The first flexible element 234 is connected to the support structures 222*a-b* by pin 238 at a first end and to the yoke 230 and the hook 232 at a second end. The second flexible element 236 is connected to the support structures 222*a-b* by pin 240 at a first end and to the hook 232 at a second end. Each of the first flexible element 234 and the second flexible element 236 includes two members, one proximate to a first support structure 222*a* and one proximate to a second support structure 222*b*, such that the hook 232 may swing between the two members of each of the first flexible element 234 and the second flexible element 236.

The first flexible element 234 and the second flexible element 236 are approximately U shaped, allowing them to flex and relax as the moveable assembly 224*a* is moved. This flexibility allows the moveable assembly 224*a* to compensate, i.e. not break, if the tank assembly 200 is forced into the robot 100 while the handle 226 is in the second position (parallel to surface 208). When inserting the tank assembly 200 into the robot 100, the handle 226 is recommended to be in the first position (perpendicular to surface 208) as the moveable assembly 224*a* is out of the way of the corresponding catch 112*a* of the receiving surface 110. When inserting the tank assembly 200 into the robot 100 with the handle 226 in the second position, the moveable assembly 224 interferes with the corresponding catch 112*a* and must flex around the catch 112*a*. This flexibility also allows the moveable assembly 224*a* to flex as the first flexible element 234 interfaces with a roller 242 on the support structures 222*a-b*. As the first flexible element 234 interfaces with the roller 242, resistance is introduced and a user moving the handle between the first position and the second position is given tactile feedback that the moveable assembly 224*a* is moving. Because of the positioning of the moveable assembly 224*a* and the roller 242, the user feels the introduced resistance at a beginning of moving the handle 226 between the first position (perpendicular to surface 208) and the second position (parallel to surface 208).

In some implementations, as described herein, the first flexible element 234 and the second flexible element 236 are elastomeric pieces. In some implementations, as described herein, the first flexible element 234 and the second flexible element 236 may be approximately bar shaped, curved, or spring shaped, to introduce flexibility into the moveable assembly 224*a*.

The moveable assembly 224*a* includes four components of a six-bar linkage that functions to secure the tank assembly 200 to the robot 100. The support structures 222*a* and 222*b* make up the fifth component and the handle 226 is the sixth component of the six-bar linkage. The six-bar linkage includes a four-bar linkage driven by a two-bar linkage. The two-bar linkage includes the yoke 230 and the handle 226. The four-bar linkage includes the first flexible element 234, the second flexible element 236, the hook 232, and the support structures 222*a-b* (which form a stationary fourth component of the four-bar linkage). As the handle 226 is moved, the two-bar linkage drives the four-bar linkage to move as well, this movement being shown in the series of FIGS. 4A-4F.

Figure 4A:
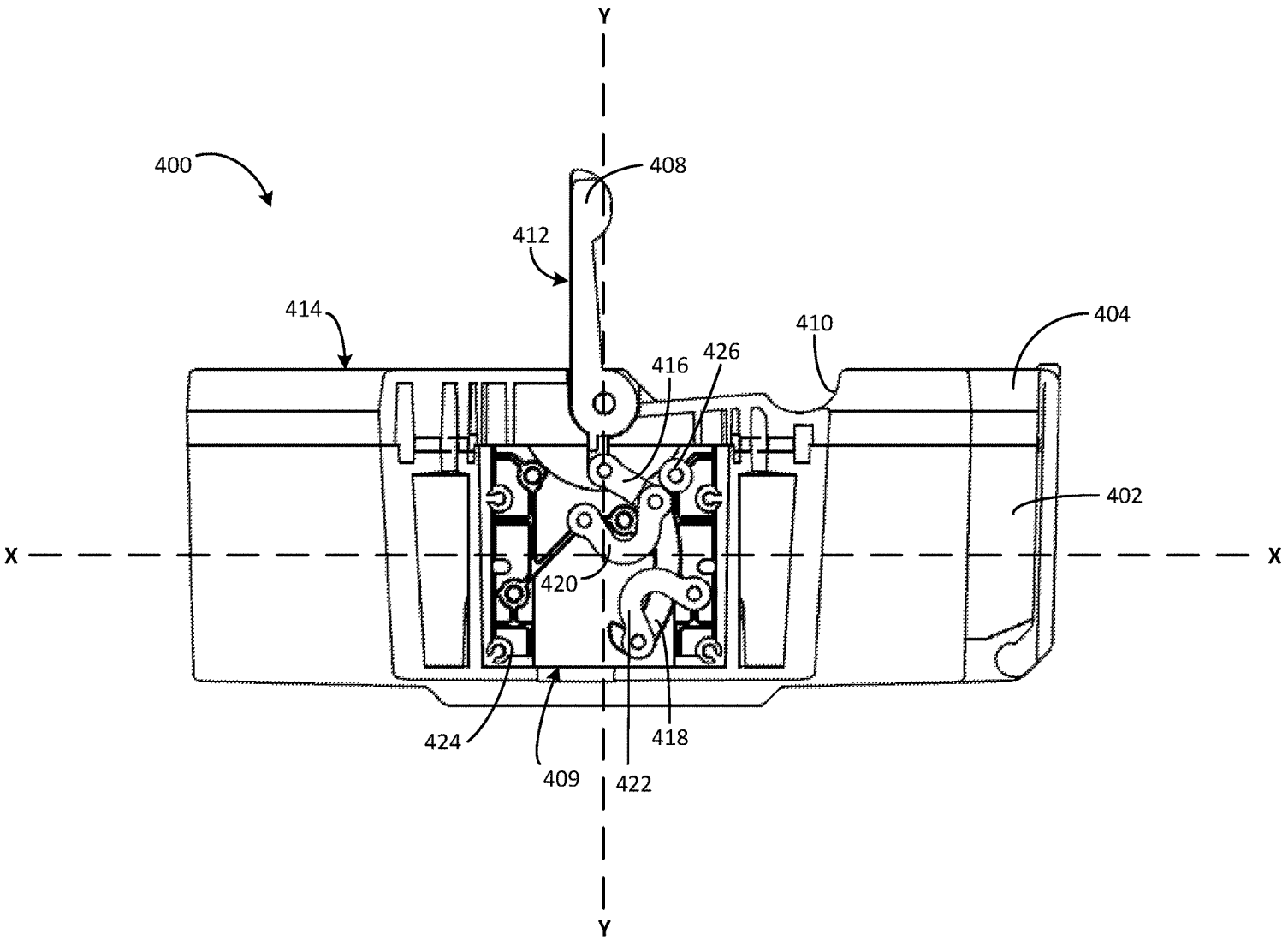
FIGS. 4A-4F are cross-sectional views of a latch assembly disposed in the tank assembly of FIG. 2 and show the positions of the latch assembly as a handle is moved from a first position to a second position.

FIGS. 4A-4F are cross-sectional views of a latch assembly (similar to the left latch assembly 220*a* and the right latch assembly 220*b*) disposed in the tank assembly of FIG. 2 and show the positions of the latch assembly as a handle is moved from a first position (perpendicular to surface 208) to a second position (parallel to surface 208). The latch assembly shown is a left latch assembly 409. The latch assembly is approximately bisected by axis X-X and axis Y-Y in FIGS. 4A-4F. Axis Y-Y is approximately perpendicular to the pivot axis of the handle 408. Referring to FIG. 4A, the handle 408 is in the first position. In the first position, a top surface 412 of the handle 408 is approximately perpendicular to the top surface 414 of the tank cover 404 and approximately parallel to axis Y-Y. In the first position of the handle 408, the hook 418 is positioned in a lower right quadrant of the latch assembly 409. A catch of a receiving surface of the robot 100 (shown in FIG. 1B) is positioned approximately in the lower left quadrant when the tank assembly 400 is seated in the robot 100. The first flexible element 420 is attached to the support structure 424 at a location in the upper left quadrant of the latch assembly 409 and the second flexible element 422 is attached to the support structure 424 at a location in the lower right quadrant of the latch assembly 409. The yoke 416 hook 422 and first flexible element 420 are attached at a location in the upper right quadrant of the latch assembly 409 proximate to a roller 426, which is attached to the support structure 424 at a location in the upper right quadrant. The handle 408 is attached to the yoke 416 approximately on the axis Y-Y.

Figure 4B:
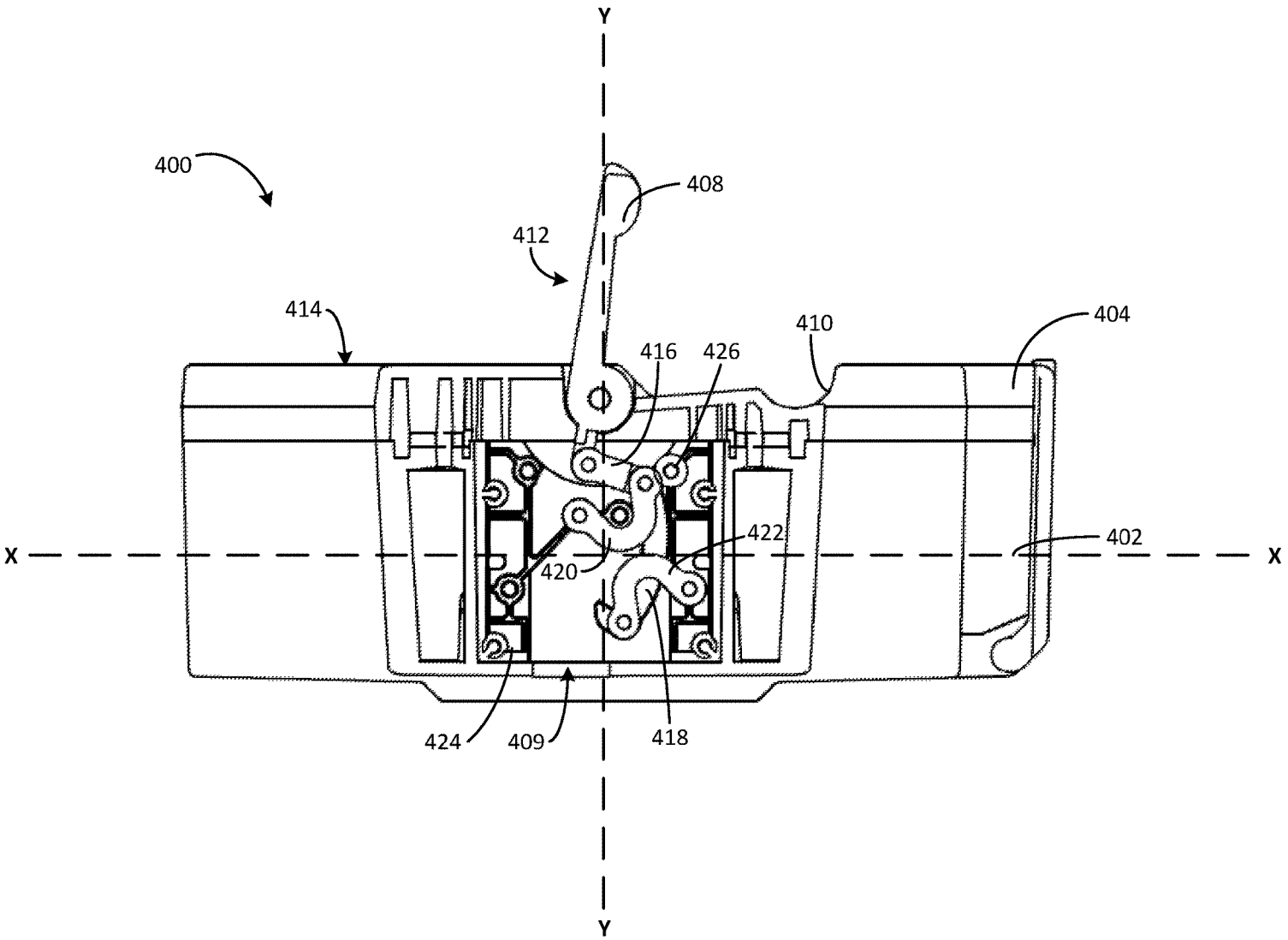

Referring to FIG. 4B, as the handle 408 moves out of the first position, pivoting toward axis X-X in a clockwise rotational direction, the handle 408 pulls the yoke 416 into the upper left quadrant such that the attachment of the handle 408 and the yoke 416 is in the upper left quadrant. As the handle 408 pulls the yoke 416, the handle also pulls the hook 418 and the first flexible element 420 upward away from axis X-X. As the first flexible element 420 and the hook 418 are pulled upward, a portion of the first flexible element 420 contacts the roller 426. As the first flexible element 420 contacts the roller 426, resistance is introduced into the movement of the handle 408 from the first position into the second position. This resistance can be felt by a user moving the handle 408 and provides tactile feedback that the handle 408 is functioning to move the tank assembly 400 into a locked position with the robot 100. The flexibility of the first flexible element 420 and the second flexible element 422, due to their shapes, allows the portion of the first flexible element 420 to slide past the roller 426 without breaking the moveable assembly of the latch assembly 409. The yoke 416 also pulls the hook 418 upward and the hook 418 swings such that a tip of the hook 418 enters the lower left quadrant.

Figure 4C:
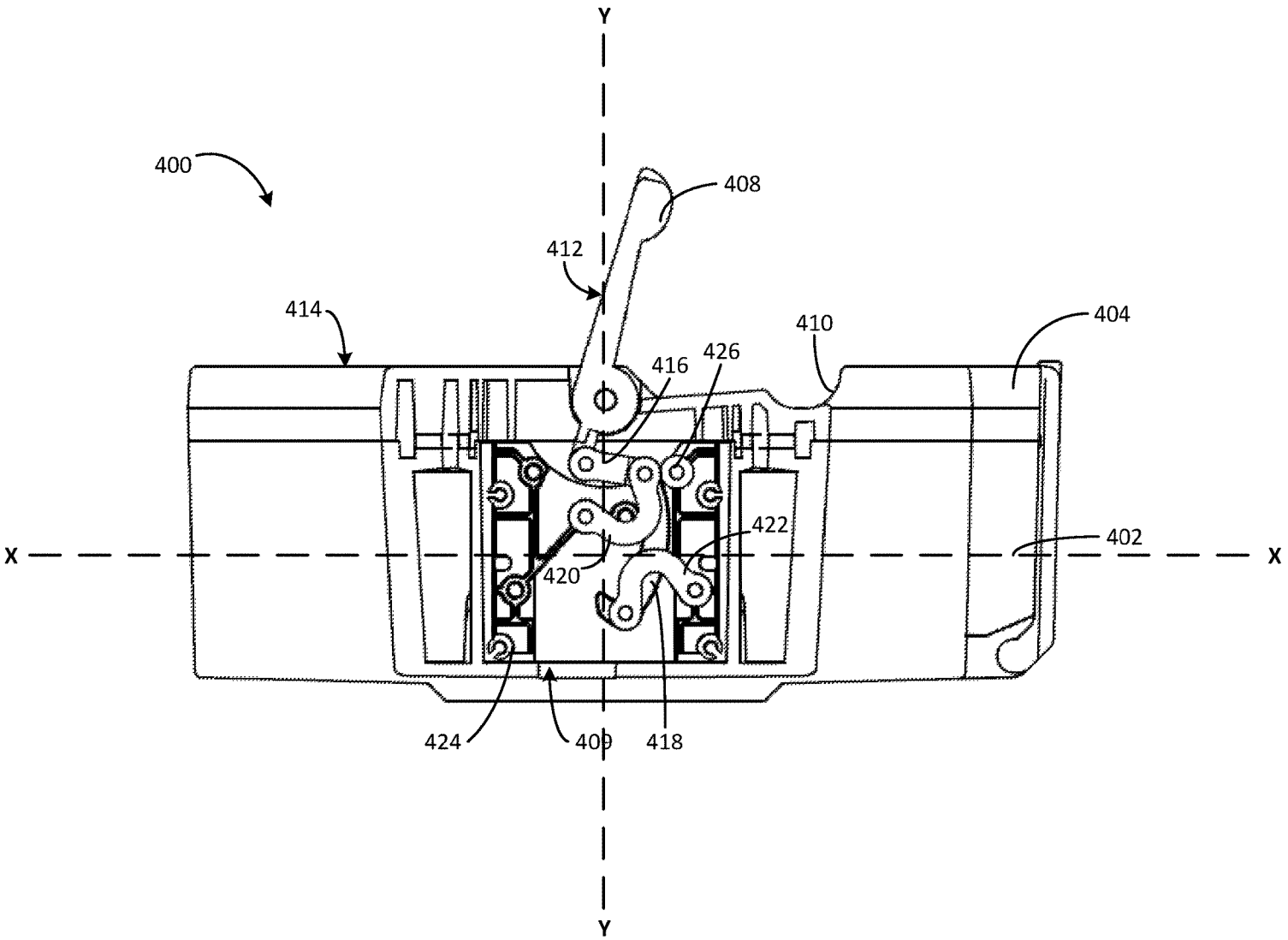

Referring to FIG. 4C, as the handle pivots further toward axis X-X, the yoke 416 is pulled further into the upper left quadrant, away from axis Y-Y, and the first flexible element 420 is pulled past the roller 426 located in the upper right quadrant. As the first flexible element 420 clears the roller 426, the resistance on movement of the handle 408 is reduced. The tip of the hook 418 remains in the lower left quadrant but is pulled upward, generally along axis Y-Y, toward axis X-X. As the hook 418 is pulled upward, the second flexible element 422 is also pulled upward and a portion of the second flexible element 422 enters the upper right quadrant.

Figure 4D:
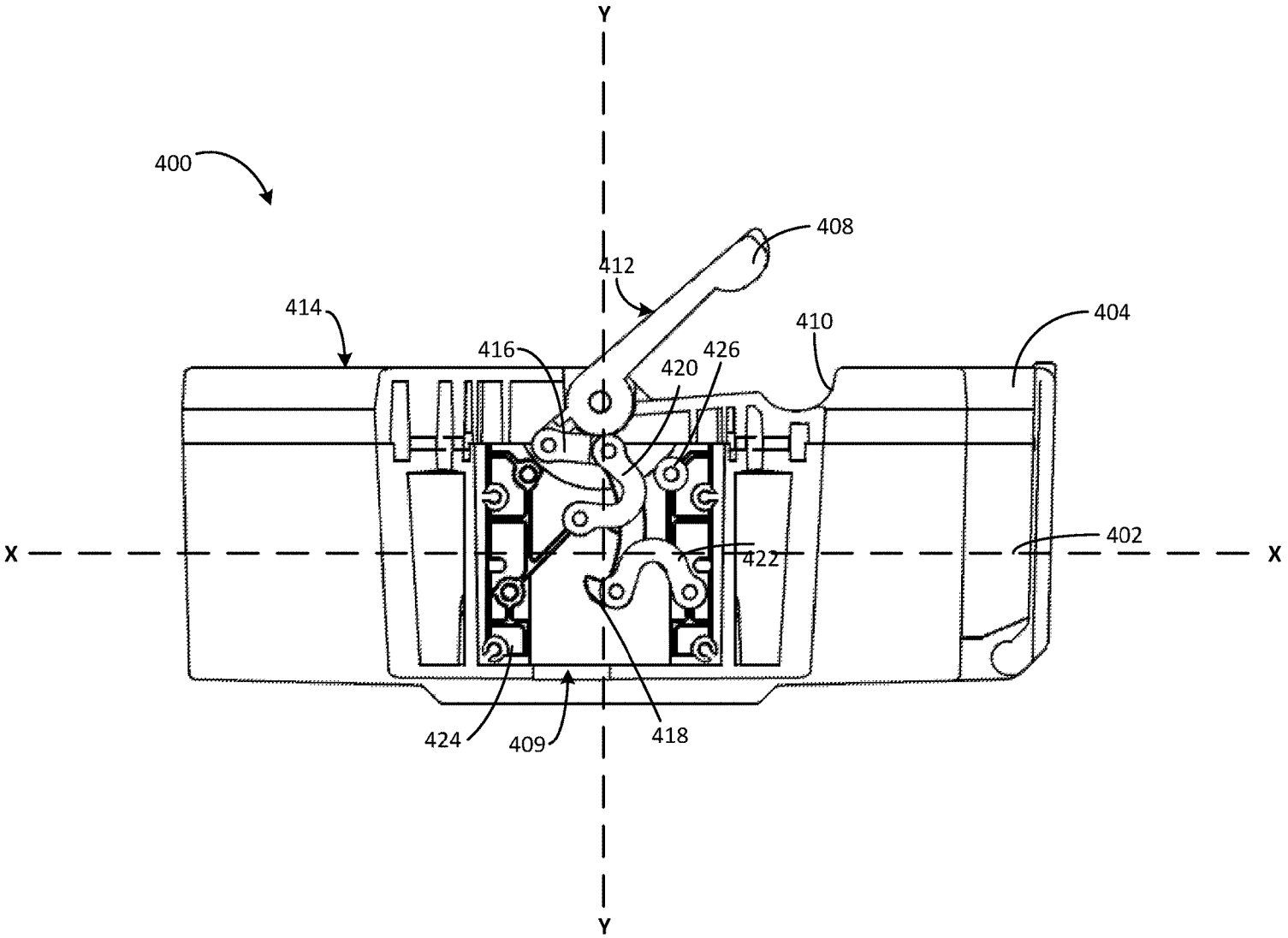

Referring to FIG. 4D, as the handle 408 is approximately halfway between the first position (where surface 412 is approximately parallel to axis Y-Y) and the second position (where surface 412 is approximately parallel to axis X-X), the yoke 416 is pulled such that the intersection of the yoke 416, the hook 418, and the first flexible element 420 approximately reaches axis Y-Y. As the yoke 416 is pulled into the upper left quadrant, a portion of the first flexible element 420 contacts the handle 408. As the first flexible element 420 contacts the handle 408, resistance is introduced into the movement of the handle 408 from the first position into the second position similar to the resistance introduced as the first flexible element 420 contacts the roller 426 as described above. This resistance can be felt by a user moving the handle 408 and provides tactile feedback that the handle 408 is functioning to move the tank assembly 400 into a locked position with the robot 100. The flexibility of the first flexible element 420 and the second flexible element 422, due to their shapes, allows the portion of the first flexible element 420 to slide past the roller 408 without breaking the moveable assembly of the latch assembly 409. The hook 418 is further pulled upward toward axis X-X as the handle 408 moves toward the second position.

Figure 4E:
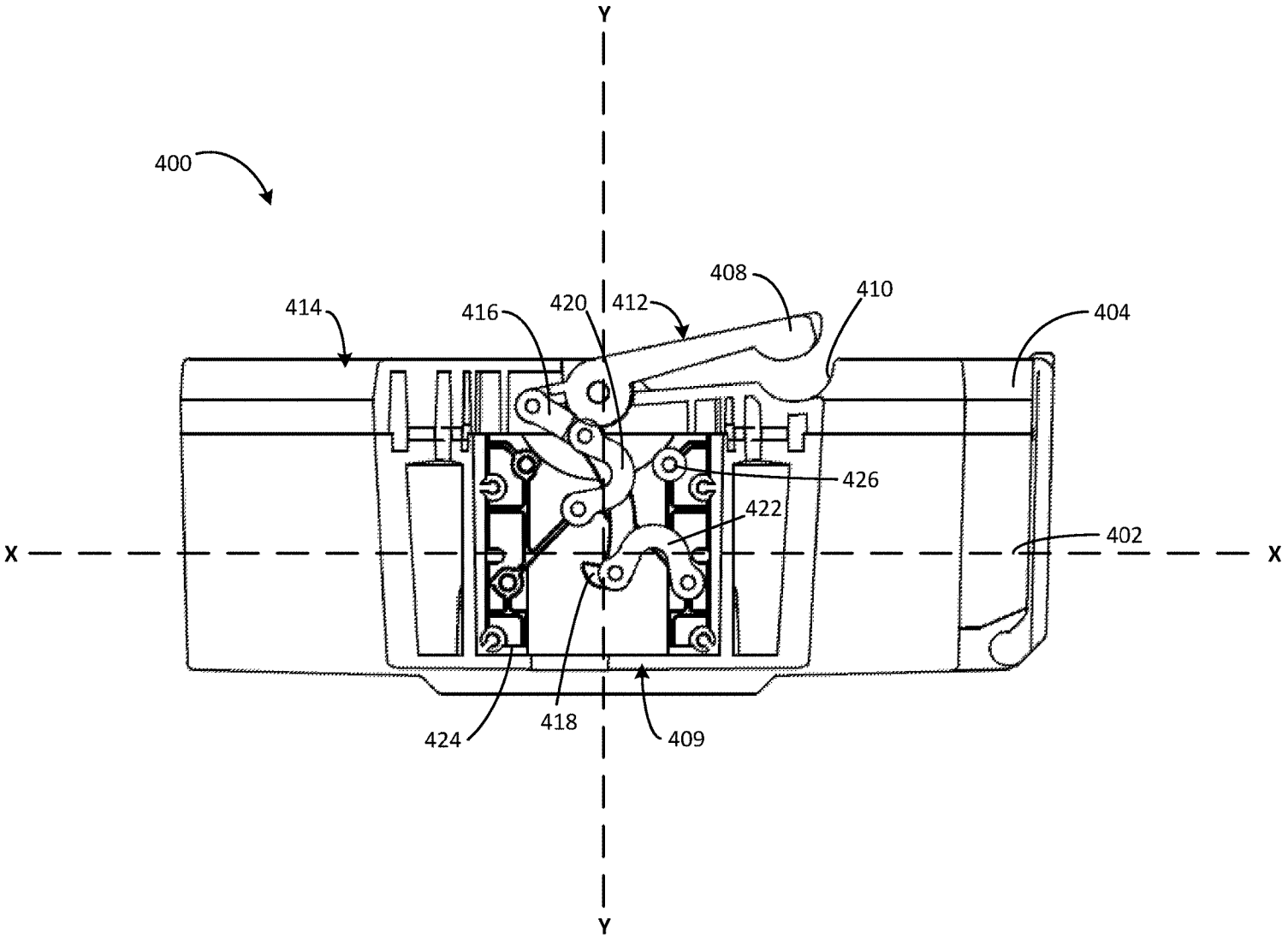

Referring to FIG. 4E, as the handle 408 continues to move toward the second position, the yoke 416 is pulled such that the intersection of the yoke 416, the hook 418, and the first flexible element 420 passes axis Y-Y and enters the upper left quadrant. A portion of the first flexible element 420 continues to interface with the handle 408 such that resistance is produced in the movement of the handle 408 from the first position into the second position. As the first flexible element 420 slides past the handle 408, the first flexible element 420 flexes such that the two ends of the first flexible element 420 (where the first flexible element 420 connects to the support structure 424 and where the first flexible element 420 connects to the yoke 416 and the hook 418) are moved closer to one another. The hook 418 is further pulled upward toward axis X-X as the handle 408 moves toward the second position. The second flexible element 422 moves further upward into the upper right quadrant.

Figure 4F:
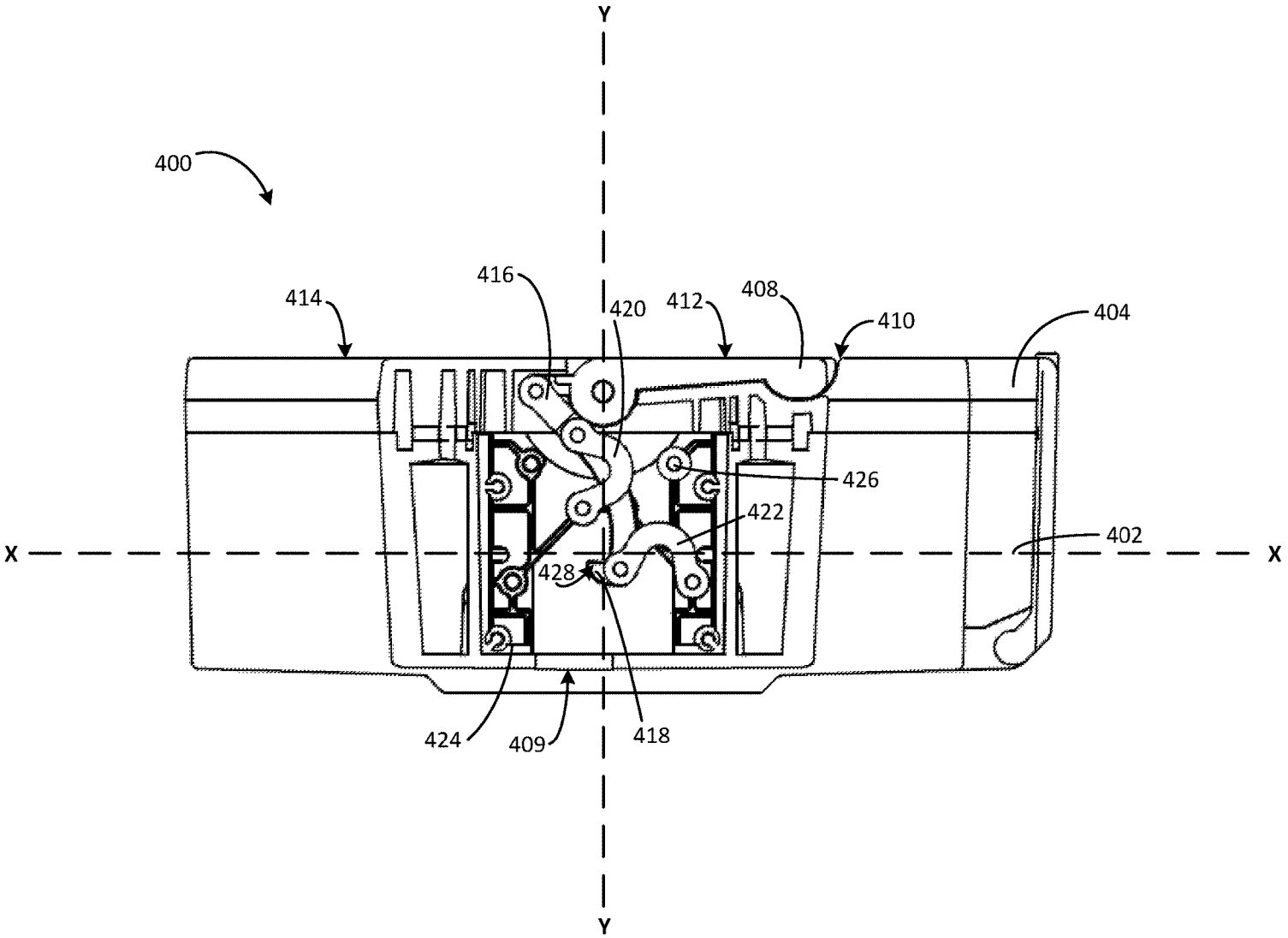

Referring to FIG. 4F, as the handle 408 reaches the second position (with surface 412 being approximately parallel to axis X-X), the yoke 416 is pulled to a highest position such that the connection of the yoke 416 and the handle 408 is approximately coplanar with a pivot axis of the handle 408 with respect to axis X-X. The first flexible element 420 is pulled such that a first end of the first flexible element and a second end of the first flexible element 420 are approximately coplanar with one another with respect to axis Y-Y. The second flexible element 422 is pulled such that the end of the second flexible element 422 that is connected to the hook 418 is higher (i.e. closer to axis X-X) than the end of the second flexible element 422 that is connected to the support structure 424. The hook 418 is pulled to a highest position closest to axis X-X. In the highest position, the hook 418 interfaces with a catch of the receiving surface 110 of the robot 100 (as shown in FIG. 1B).

As the hook 418 contacts the catch of the receiving surface 110, force is loaded onto the catch through the moveable assembly 224*a* (as the handle is pulling upward on the yoke 416, which transfers force to the hook 418). The force loaded onto the catch produces a sealing force on the seal 114 (shown in FIG. 1B) between the tank assembly 400 and the robot 100. The seal 114 is sandwiched between the receiving surface 110 and the tank assembly 400 as the hook 418 loads force onto the catch of the receiving surface 110. The sealing force on the seal 114 may be between approximately 5 and 20 foot-pounds (e.g., approximately 5-10 foot-pounds, 10-15 foot-pounds, 15-20 foot-pounds). The sealing force on the seal 114 seals a pathway between the reservoir 205 (shown in FIG. 2) of the tank assembly 400 and the robot 100, where the fluid is delivered to the floor surface during a cleaning mission. The sealing force on the seal 114 allows the tank assembly 400 to hold fluid, without leaking, and deliver it to the robot 100 as the robot 100 traverses a floor surface. Because the robot 100 may change direction rapidly, may bump into obstacles, and/or may be tilted during a cleaning mission, a sealing force on the seal 114 is required.

In some instances, a user may attempt to attach the tank assembly 400 to the robot 100 with the handle in the second position, as shown in FIG. 4F. When the user attempts to attach the tank assembly 400 to the robot 100 in such a manner, moving the hook 418 toward a corresponding catch of the receiving surface (shown in FIG. 1B), the catch would first contact the hook 418 on a curved portion of the hook and not on an interfacing surface 428 of the hook (which faces upward toward axis X-X). The flexibility of the first flexible element 420 and the second flexible element 422 allow the hook 418 to move past the catch without the moveable assembly 224*a* breaking. As the hook 418 comes into contact with the corresponding catch, the hook 418 would slide toward the lower right quadrant (a curved shape of the hook 418 directing motion of the hook 418 as it slides) until the tip of the hook 418 clears the corresponding catch. When the tip of the hook 418 clears the corresponding catch, the hook 418 would snap to a position where the interfacing surface 428 contacts the corresponding catch and where the sealing force, as described above, is loaded onto the catch from the hook 418.

Removing Fluid from the Tank Assembly

Figure 5:
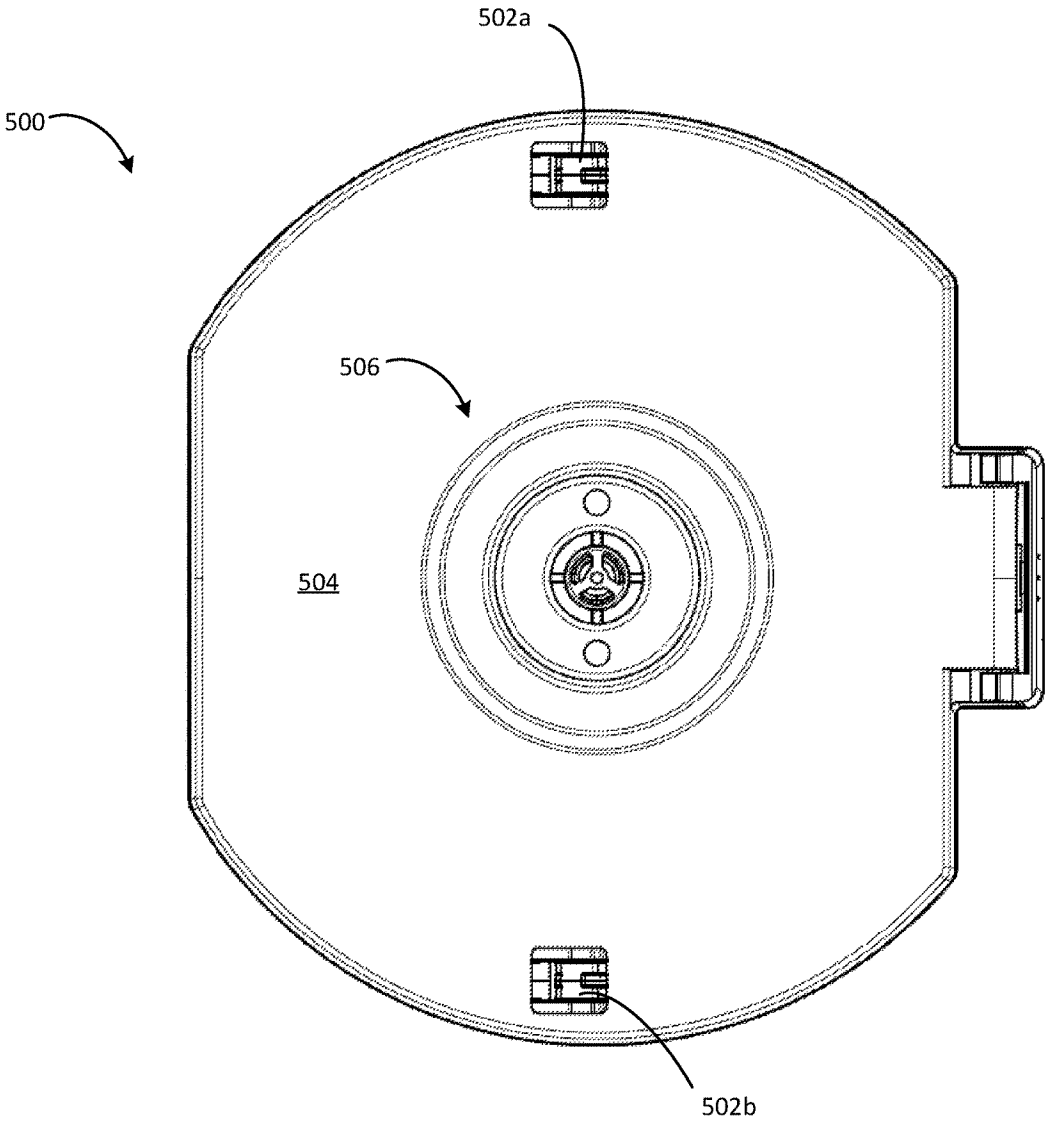
FIG. 5 is a bottom view of the tank assembly of FIG. 2.

FIG. 5 shows a bottom view of a tank assembly 500 of the cleaning robot 100 shown in FIGS. 1A and 1B. The tank assembly 500 has two openings 502*a* and 502*b* in a bottom surface 504 of the tank assembly 500. Opening 502*a* is positioned on the bottom surface 504 at the bottom of the left receptacle 206*a*. The left catch 112*a* on the receiving surface 110 of the robot 100 extends through opening 502*a* when the tank assembly 500 is received by the robot 100. Similarly, opening 502*b* is positioned on the bottom surface 504 at the bottom of the right receptacle 206*b*. The right catch 112*b* on the receiving surface 110 of the robot 100 extends through opening 502*b* when the tank assembly 500 is received by the robot 100. When the catches 112*a* and 112*b* extend through corresponding openings 502*a* and 502*b*, the catches 112*a* and 112*b* may interface with corresponding hooks of the latch assemblies 220*a* and 220*b* disposed in the left and right receptacles 206*a* and 206*b*.

Figure 6A:
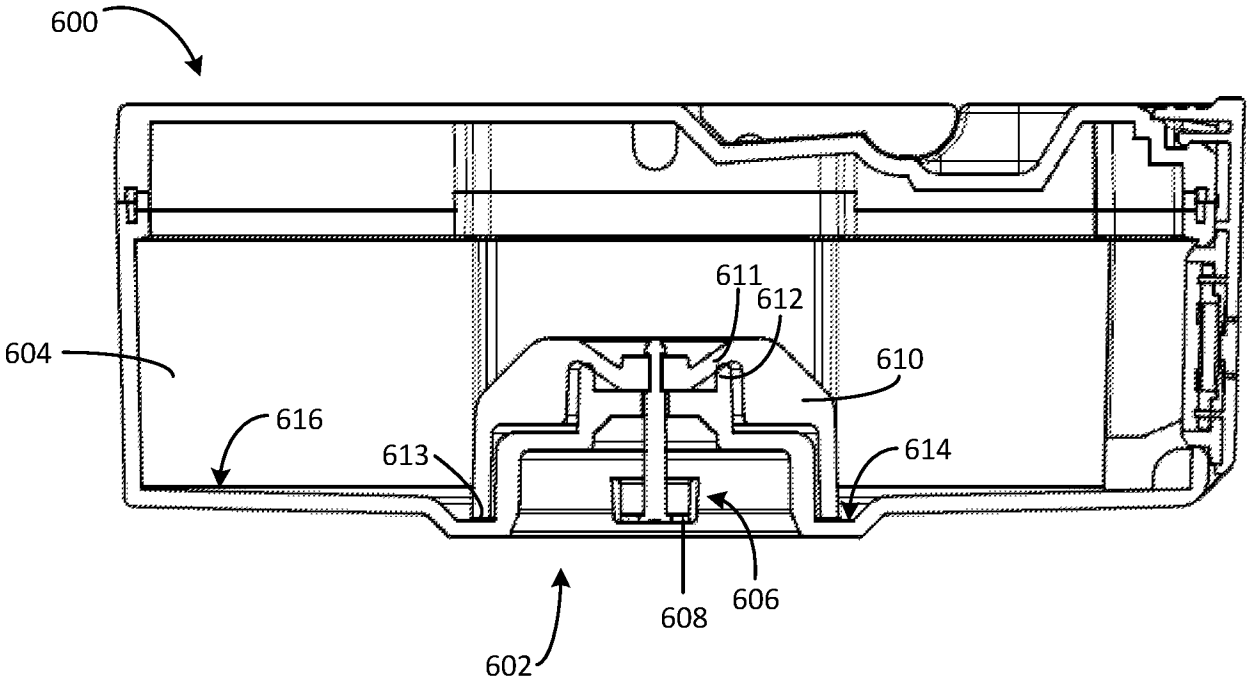
FIG. 6A is cross-sectional view of the tank assembly of FIG. 2 when a plunger is in an extended position.

FIG. 6A is cross-sectional view of the tank assembly 600 when a plunger is in an extended position. The tank assembly 600 has a snorkel assembly 602 located at a bottom of a reservoir 604 of the tank assembly 600. The snorkel assembly 602 prevents the reservoir 604 from leaking and is configured to permit fluid within the reservoir 604 to be removed from the reservoir 604 when the tank assembly 600 is positioned in the robot 100. As such, the fluid within the reservoir 604 can be applied to the floor surface during a cleaning mission.

The snorkel assembly 602 includes a plunger 606 with a head 608. The plunger 606 is biased by a spring (not shown) in an extended position as shown in FIG. 6A. The plunger 606 is connected to a snorkel 610 of the snorkel assembly 602. When the plunger 606 is in the extended position, the snorkel 610 is in a sealing position where a cone 611 of the snorkel 610 contacts a protrusion 612 of a bottom surface 616 of the reservoir 604 and forms a seal. In the sealing position, rim 613 of the snorkel 610 contacts a recessed portion 614 of a bottom surface 616 of the reservoir 604. In some implementations, the recessed portion 614 of the bottom surface 616 of the reservoir 604 is ribbed such that fluid is able to pass between the rim 613 of the snorkel 610 and the protrusion 612. With the plunger 606 in the extended position and the snorkel 610 in the sealing position, fluid contained in the reservoir 604 is prevented from exiting the reservoir 604.

Due to a low profile of the cleaning robot 100 (the cleaning robot is approximately between 75 and 95 mm tall (e.g., approximately 75-80 mm, 80-85 mm, 85-90, 90-95 mm)) the mechanism for sealing the reservoir 604 of the tank assembly 600, here the snorkel assembly 602, is located internal to the tank. The sealing surface formed between the cone 611 and the protrusion 612 is between approximately 16 and 24 mm (e.g., approximately 16-18 mm, 18-20 mm, 20-22 mm, 22-24 mm) above the bottom surface 616 of the reservoir 604. Due to the geometry of the snorkel 610 and the recessed surface 614, fluid may be removed out of the reservoir 604 down to the level of the bottom surface 616 of the tank despite the sealing surface being located above the bottom surface 616.

Figure 6B:
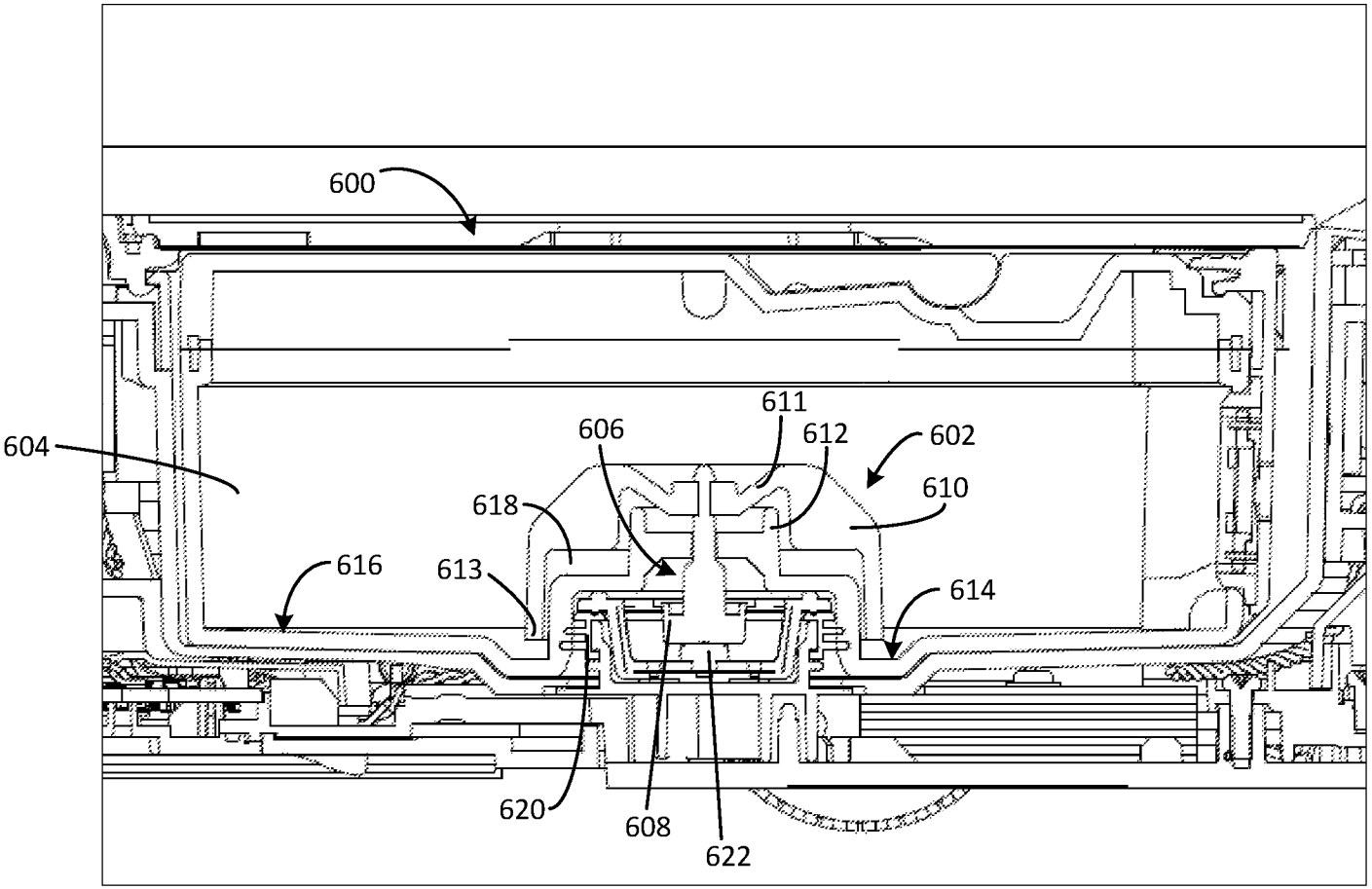
FIG. 6B is a cross-sectional view of the tank assembly of FIG. 2 when a plunger is in a retracted position.

FIG. 6B is a cross-sectional view of the tank assembly 600 when the plunger 606 is in a retracted position. When the tank assembly 600 is inserted into the robot 100, the plunger 606 contacts a feature 622 of the filter 114 (as shown in FIG. 1B). The feature 622 exerts a force on the plunger 606, causing the spring (not shown) to contract, and moves the plunger 606 into the retracted position shown in FIG. 6B. When the plunger 606 moves into the retracted position, the snorkel 610 moves into a snorkeling position where the cone 611 of the snorkel is lifted off of the protrusion 612 of the bottom surface 616 of the reservoir 604. The rim 613 of the snorkel 610 is also lifted off of the recessed portion 614 of the bottom surface 616 of the reservoir 604 providing a fluid pathway 618 between the snorkel 610 and the protrusion 612.

In the snorkeling position, the fluid flows through the fluid pathway 618, through openings in the protrusion 612, past the plunger head 608, and out of the reservoir 604. After flowing out of the reservoir 604, the fluid flows into a holding area in the cleaning robot 100. The seal 620 prevents fluid flowing out of the reservoir from leaking as it flows into the robot 100. From the holding area, the fluid may be applied to the floor surface (e.g., by spraying, diffusion to a cleaning pad, etc.). In some implementations, the fluid is pumped from the holding area through tubing in the cleaning robot 100 to a nozzle for spraying the fluid onto the floor surface.

A number of implementations have been described. Nevertheless, it will be understood that various modifications may be made. Accordingly, other implementations are within the scope of the claims.

What is claimed is:

1. An autonomous cleaning robot, comprising: a drive configured to propel the robot along a floor surface; a tank assembly comprising:

a reservoir;

left and right receptacles;

a handle extending across a cover of the tank assembly, the handle being moveable between a first position and a second position, wherein when the handle is in the second position, the tank assembly is locked in position; and left and right latch assemblies receivable by the left and right receptacles, respectively, each latch assembly comprising:

a moveable assembly configured to lock the tank assembly in position such that fluid in the reservoir can be delivered from the reservoir to the floor surface when the handle is in the second position, the moveable assembly comprising:

a yoke pivotally connected to the handle;

a hook pivotally connected to the yoke, the hook configured to move from a first position to a second position and engage with a corresponding catch of the robot and lock the tank assembly in position when the hook is in the second position; and a first flexible element connected to the yoke and the hook and a second flexible element connected to the hook, wherein flexibility of the first flexible element and the second flexible element allows the tank assembly to be received and locked into position when the handle is in the second position.

2. The robot of claim 1, wherein the first flexible element and the second flexible element are approximately U-shaped.

3. The robot of claim 1, wherein each of the first flexible element and the second flexible element have two members separated from one another to allow the hook to move between the members.

4. The robot of claim 1, wherein each of the latch assemblies further comprise a roller configured to produce resistance against the handle when moving the handle from the first position to the second position.

5. The robot of claim 1, wherein the moveable assembly is configured such that the first flexible element produces resistance against the handle when moving the handle from the first position to the second position.

6. The robot of claim 1, wherein each of the left and right receptacles comprises an opening to receive the corresponding catch of the robot.

7. The robot of claim 1, wherein the moveable assembly is configured such that the hook travels more during a first portion of the handle's movement than during a second portion of the handle's movement from the first position to the second position.

8. The robot of claim 1, further comprising a seal configured to seal the tank assembly to a surface of the autonomous cleaning robot.

9. The robot of claim 8, wherein a force applied to the seal is between approximately 5 and 20 foot-pounds when the tank assembly is locked into position.

10. A tank assembly for an autonomous cleaning robot movable across a floor surface, the tank assembly comprising:

a reservoir;

left and right receptacles;

a handle extending across a cover of the tank assembly, the handle being moveable between a first position and a second position, wherein when the handle is in the second position, the tank assembly is locked in position; and left and right latch assemblies receivable by the left and right receptacles, respectively, each latch assembly comprising:

a moveable assembly configured to lock the tank assembly in position such that fluid in the reservoir can be delivered by the autonomous cleaning robot from the reservoir to the floor surface when the handle is in the second position, the moveable assembly comprising:

a yoke pivotally connected to the handle;

a hook pivotally connected to the yoke, the hook configured to move from a first position to a second position and engage with a corresponding catch of the robot and lock the tank assembly in position when the hook is in the second position: and a first flexible element connected to the yoke and the hook and a second flexible element connected to the hook, wherein flexibility of the first flexible element and the second flexible element allows the tank assembly to be received and locked into position when the handle is in the second position.

11. The tank assembly of claim 10, wherein the first flexible element and the second flexible element are approximately U-shaped.

12. The tank assembly of claim 10, wherein each of the first flexible element and the second flexible element have two members separated from one another to allow the hook to move between the members.

13. The tank assembly of claim 10, wherein each of the latch assemblies further comprise a roller configured to produce resistance against moving the handle from the first position to the second position.

14. The tank assembly of claim 10, wherein the moveable assembly is configured such that the first flexible element produces resistance against the handle when moving the handle from the first position to the second position.

15. The tank assembly of claim 10, wherein each of the left and right receptacles comprises an opening to receive the corresponding catch of the robot.

16. The tank assembly of claim 10, wherein the moveable assembly is configured such that the hook travels more during a first portion of the handle's movement than during a second portion of the handle's movement from the first position to the second position.

* * * * *